United States Patent [19]

Burnbaum

[11] 4,339,787

[45] Jul. 13, 1982

[54] CHRISTMAS DECORATION

[75] Inventor: Jack Burnbaum, Newton, Mass.

[73] Assignee: Bradford Novelty Co., Inc., Boston, Mass.

[21] Appl. No.: 166,140

[22] Filed: Jul. 7, 1980

[51] Int. Cl.[3] ..... F21P 1/02

[52] U.S. Cl. ..... 362/121; 362/235; 362/252; 362/307; 362/368; 362/375; 362/382

[58] Field of Search ..... 362/235, 252, 121, 307, 362/368, 375, 382

[56] References Cited

U.S. PATENT DOCUMENTS 2,773,590 12/1956 Levinson ..... 362/807

*Primary Examiner*—Stephen J. Lechert, Jr.

*Attorney, Agent, or Firm*—Wolf, Greenfield & Sacks

[57] ABSTRACT

This invention relates to Christmas ornaments and more particularly comprises a new and improved Christmas tree-top ornament that provides a most unusual tunnel-light decoration.

8 Claims, 10 Drawing Figures

FIG. 7
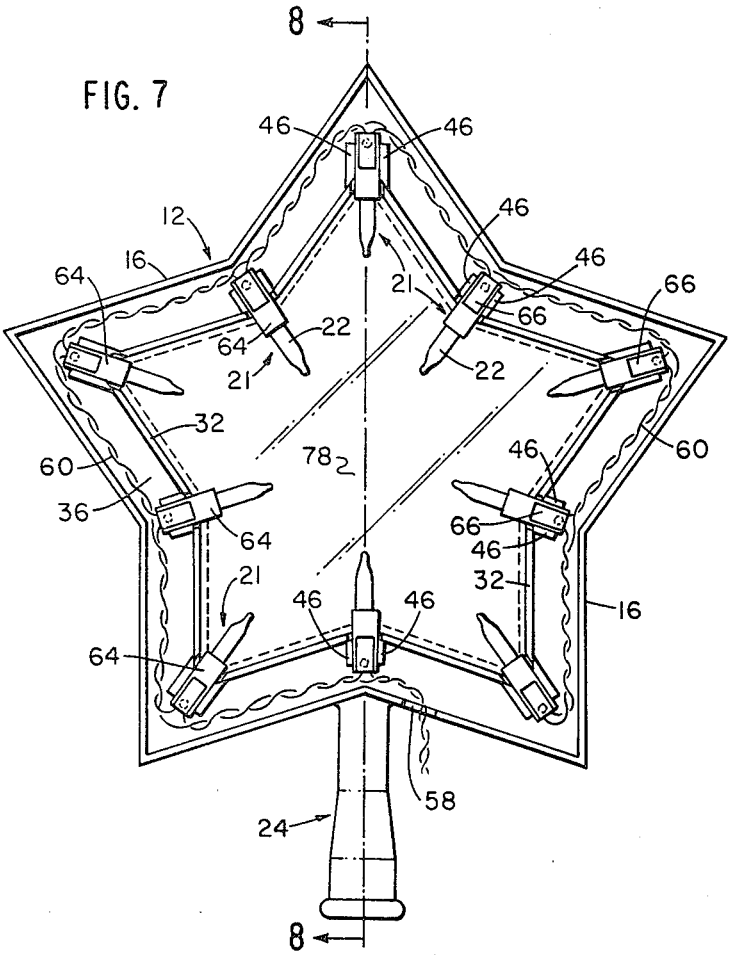
FIG. 8
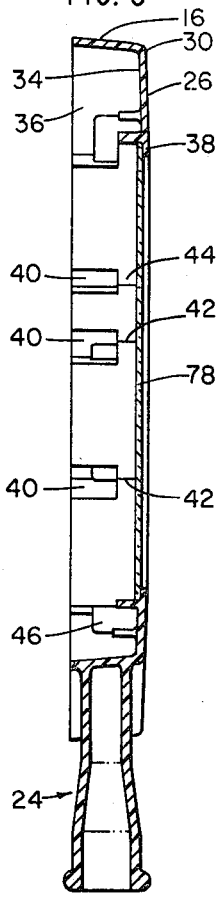
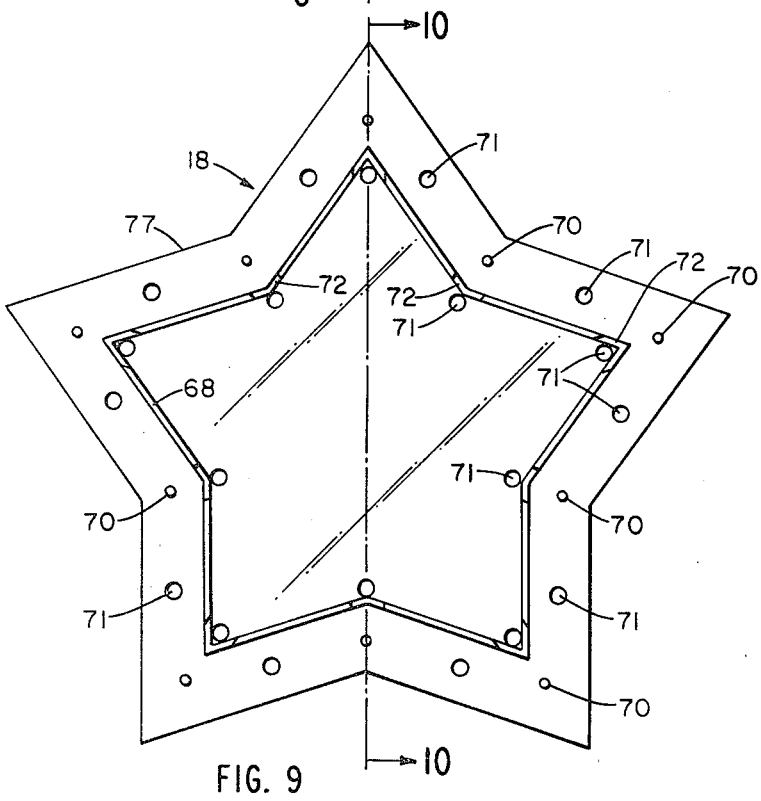
FIG. 9
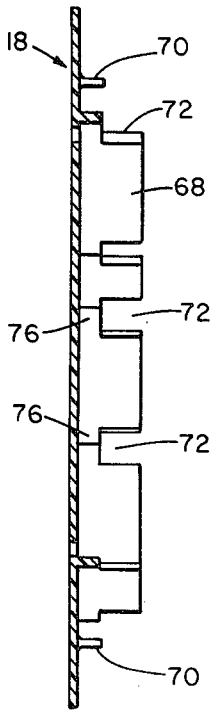
FIG. 10

CHRISTMAS DECORATION

There are of course a great variety of ornaments made for the tops of Christmas trees, and many of them are star-shaped and include lights that create a very pleasing effect. The principal object of the present invention is to provide a unique, lighted, star-shaped decoration for Christmas trees that is relatively inexpensive to manufacture but provides maximum decorative impact.

In order to reduce the manufacturing costs of such tree-top ornaments, it is essential that they be capable of being assembled very rapidly. Assembly time is minimized when no special fasteners are employed to hold the various parts together and no careful orientation is required of one part with respect to another. Assembling is also aided when the various parts automatically align themselves when brought into proper final assembled relationship.

In accordance with the present invention the star-shaped ornament is composed essentially of four parts, namely a front cover, back, window and electrical subassembly composed of lights, sockets, and wiring. The four parts are assembled together without the use of screws, rivets or other forms of fasteners and can readily be opened by the user should a light bulb require replacement. The cover and back require a minimum of orientation with respect to one another to assemble them together, and the window is merely dropped in place in the cover and the electrical subassembly is readily positioned about the cover prior to connecting the cover and back. The cover and back may be injection molded of inexpensive material, and their configuration is such that the tools required for molding are not expensive.

In spite of the economies involved in the manufacture of the device, it provides a very striking effect when mounted on a Christmas tree. The reflective coating on the front surface of the back which may be viewed through the window and the reflective window itself produce a star-shaped tunnel-light effect which is particularly striking.

The invention will be better understood and appreciated from the following detailed description of one embodiment thereof, selected for purposes of illustration and shown in the accompanying drawing.

BRIEF FIGURE DESCRIPTION

FIG. 7 is a rear elevation view of the cover of the ornament shown in FIG. 1 with the electrical subassembly mounted in place.

FIG. 8 is a cross-sectional view taken along the section line 8—8 of FIG. 7, with the electrical subassembly removed.

FIG. 9 is a front elevation view of the back of the ornament.

FIG. 10 is a cross-sectional view taken along the section line 10—10 in FIG. 9.

DETAILED DESCRIPTION

Figure 1:
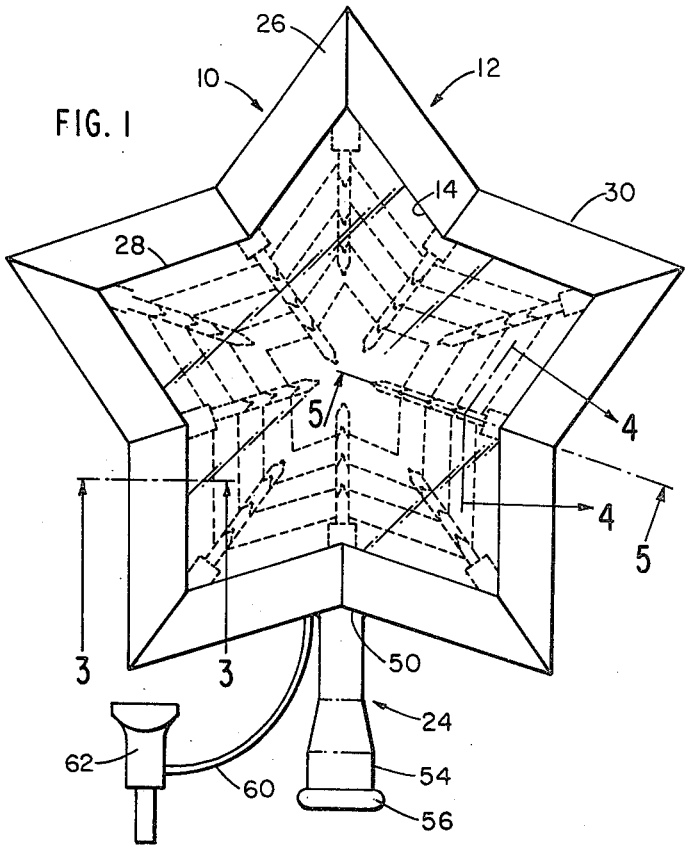
FIG. 1 is a front elevation view of a Christmas tree ornament of this invention and suggesting the tunnel-light effect produced by the lights within it.
Figure 2:
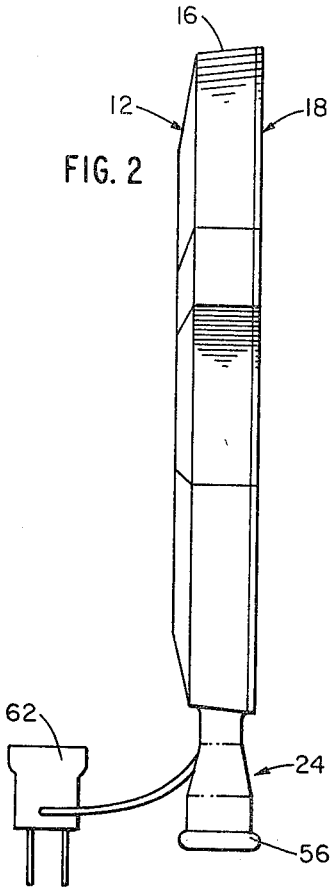
FIG. 2 is a side elevation view of the ornament shown in FIG. 1.
Figure 3:
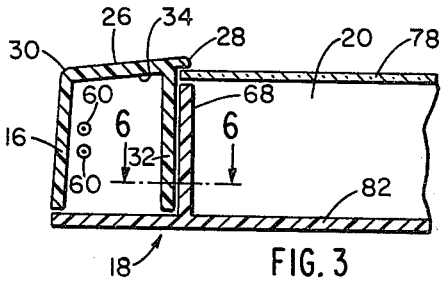
FIGS. 3, 4 and 5 are fragmentary cross-sectional views taken along the corresponding section lines in FIG. 1.

The Christmas ornament 10 of the present invention includes in its general organization a star-shaped cover 12, a back plate 18, a plurality of lights 21 and a stem 24. The cover 12 has a star-shaped opening 14 in its center and a peripheral side wall 16. The back plate 18, like the cover 12, is also star-shaped and is fitted against the peripheral side wall so as to form a chamber 20, which contains the lights 21. Stem 24, which is attached to the cover serves as a means to attach the Christmas ornament to the top of a Christmas tree. When the ornament is turned on, the lights shine through the star-shaped opening and a seemingly infinite number of lights in star-shaped patterns are reflected from the back plate out through the opening. Moreover, as the viewer changes position, the reflected lights seem to move about within the decoration. The total effect will quite readily catch the eye of a passerby.

The star-shaped cover 12 as shown in FIGS. 1 and 7 has an annular front wall 26, and the inner edge 28 of front wall 26 defines the star-shaped opening 14. The front wall 26 has an outer edge 30 which is parallel to the inner edge. Peripheral side wall 16 extends rearwardly from the outer edge 30 at a slightly obtuse angle to front wall 26. An inner wall 32 parallel to the peripheral side wall extends rearwardly from the rear surface 34 near the inner edge 28. The parallel walls 16 and 32 and front wall 26 together form a star-shaped channel 36 which is open in a rearward direction. The channel is slightly narrower than front wall 26, and the inner edge of the front wall 28 defines a lip 38 inside wall 32.

The inner wall 32 is interrupted by ten generally U-shaped openings 40. The U-shaped openings are located at the vertex 42 of each angle of the star configuration formed by the inner wall. The U-shaped openings terminate above the bottom of wall 32 leaving ten shortened wall sections 44 which are V-shaped in plan. Generally rectangular parallel walls 46, extend from the inner wall 32 toward the peripheral side wall 16 and are arranged in pairs, one on each side of each U-shaped opening. The length of the rectangular walls is less than the width of the star-shaped channel 36. A number of round posts 48 extend perpendicularly from the rear surface 34 of the front wall 26 such that one round post is located midway between each pair of generally rectangular walls. The posts extend farther than wall sections 44 from the rear surface of the front wall and when in association with similar elements on the back plate 18 firmly hold the light bulbs in place within the decoration as described below.

Figure 5:
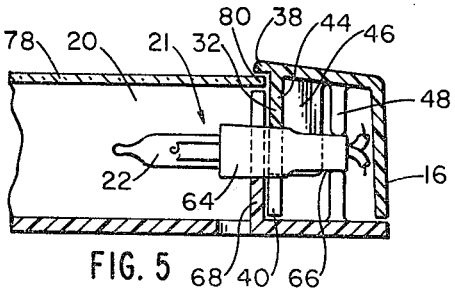
Figure 4:
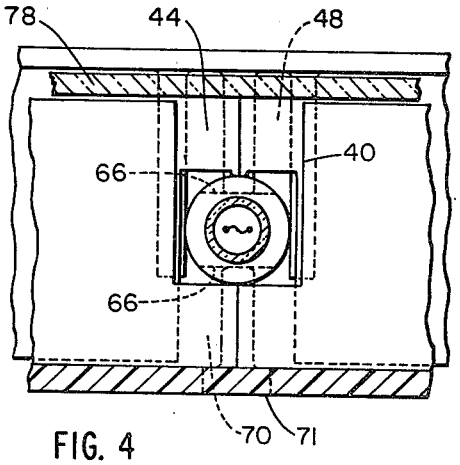

The electric lights 21 consist of an incandescent lamp 22 and a socket base 64. The lights are shown in FIGS. 5 and 7. The base is generally cylindrical and has two parallel flats 66 which are approximately half the length of the base. The flats begin at the end of the base opposite the lamp and they are closer together than the base diameter. The cylindrical portion of each light base near the lamp fits within one of the U-shaped openings 40, between the parallel walls 46. The bases are positioned with respect to the round posts 48 so that the free end of the posts are in contact with the flats 66. A pair of insulated conductors 60, connected to an electrical plug 62 and to the base 64 of each of the light bulbs, runs around the periphery of the cover 12 within the channel 36. The conductors, bases, lamps and plug comprises a subassembly that is handled as a unit when the ornament is assembled. The bases 64 of the lights are wired in series. A notch 58 as shown in FIG. 7 is provided in the peripheral side wall 16 adjacent the stem 24 near the bottom of the decoration and provides access for the conductors into the channel. The lights are securely held in place when the backplate and cover are placed together as is hereinafter described.

Figure 6:
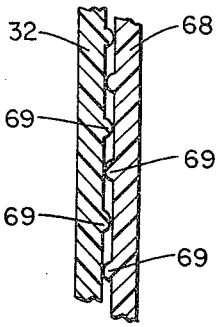
FIG. 6 is a fragmentary cross-sectional view taken along the section line 6—6 of FIG. 3.

The flat, star-shaped back plate 18 as shown in FIGS. 9 and 10 has a wall 68 extending perpendicularly from its forward surface as do a number of round posts 70. In addition, the back plate has a number of circular holes 71. The perpendicular wall forms a star which is slightly smaller than the star formed by the inner wall 32 extending from the rear surface of the cover. When the backplate and the cover 12 are assembled, the wall 68 of the back and the inner wall 32 of the cover are parallel, with wall 68 immediately inside wall 32. A firm friction fit may be achieved by providing ribs on the facing surfaces of walls 32 and 68 as suggested at 69 in FIG. 6.

The wall 68 is interrupted by a set of ten generally U-shaped openings 72 located at the vertices 74 of the star formed by the perpendicular wall, very similar to the U-shaped openings 40 in the cover. The U-shaped openings 72 terminate above the bottom of wall 68 leaving ten shortened wall sections 76 which are V-shaped in plan, and the round posts 70 are located between the perpendicular wall and the outer edge 77 of the back plate. This second set of U-shaped openings and round posts are positioned so that when the star-shaped back plate and star-shaped cover tray are placed together as previously described, the cylindrical portion of each light bulb base is held firmly between wall sections 44 and 76 and the flats are held securely between the ends of round posts 48 and 70. The circular holes 71 are located intermediate each pair of posts 70, as well as just inside the perpendicular star-shaped wall at each vertex. The holes provide a means for cooling air to circulate within the star-shaped channel 36 and the chamber 20 thereby dissipating the heat given off by the light bulbs.

When the decoration is assembled a tinted transparent plastic star-shaped window 78 is placed within the chamber 20 so that its edge 80 rests against the rear surface of lip 38. Next the subassembly made up of the lamps, bases and conductors are mounted on the cover as shown in FIG. 7, and the backplate is joined to the cover completing the assembly. The window is sandwiched between the lip 38 and the forward edge of the perpendicular wall 68. The friction fit between walls 32 and 68 should retain the assembly together.

An important element of the assembly is reflective or mirrored surface 82 provided on the forward face of the back plate 18. The rear surface of the tinted window which faces the chamber 20 also serves as a reflective surface. Thus, when the light bulbs 22 are energized, the effect on a viewer, as previously described, is that of an infinite number of star-shaped arrays of lights disappearing into the decoration away from the viewer.

The stem 24 is attached to the peripheral side wall 16 of the cover so as to bisect an obtuse angle 50 formed by the peripheral side wall at the bottom of the decoration. The diameter of the stem is greater at the free end 54 than where it meets side wall 16, and the free end of the stem has a thickened portion 56 which reinforces the open end. The stem is designated to receive the tip of a Christmas tree or the like so that the decoration may be conveniently displayed.

The decoration as hereinbefore described is simple and inexpensive to manufacture and assemble as it consists of only four separate pieces. There is no special indexing required of the star points of the back with respect to those of the cover as the points of the back fit on any of the points of the cover. And no fasteners are used to hold the assembly together. And once assembled, the lights are securely held within the ornament.

Having described this invention in detail, those skilled in the art will appreciate that numerous modifications may be made of the invention without departing from its spirit. Therefore, it is not intended that the invention be limited to the single embodiment illustrated and described. Rather, the scope of the invention is to be determined by the appended claims and their equivalents.

What is claimed is:

1. A Christmas tree ornament comprising:

a star-shaped cover having a peripheral side wall extending to one side of and generally perpendicular to the cover, said side wall conforming to the star shape of the cover and defining alternate inwardly acute angles at the outer points of the star and outward obtuse angles at the inner points of the star, an inner wall on the cover generally parallel and spaced inwardly of the peripheral side wall so as also to describe a star and extending from the same side of the cover as the peripheral wall, said peripheral and inner walls defining a channel about the cover, slots in the inner wall adjacent the inner and outer points of the star, means including parallel flanges extending into the channel from the margins of the slots and lamp sockets supported in the slots with the axes of the sockets parallel to the plane of the cover, lights mounted in each of the sockets and disposed within the inner wall and with the center line of the lights generally bisecting the points of the star, a window in the cover within the inner wall and through which all the lights are visible from the front of the cover, wiring in the channel connected to the sockets and a plug connected to the wiring and disposed outside the channel, a back conforming in shape to the star-shaped cover and having a wall on its front face that describes a star very slightly smaller than the star described by the cover inner wall so that when the back is mounted on the cover the back wall lies immediately within the inner wall, slots in the back wall opposite the slots in the cover inner wall to engage the sockets, said back having a mirrored front surface to reflect images of the lights when the ornament is viewed through the window, and means for mounting the ornament on the top of a Christmas tree.

2. A Christmas tree ornament as defined in claim 1 wherein pins provided in the channel of the cover and on the back and cooperating with the slots and flanges to hold the sockets in place.

3. A Christmas tree ornament as defined in claim 1 wherein said means for mounting the ornament including a sleeve for receiving the top of the tree.

4. A Christmas tree ornament comprising:

a housing having a cover and back defining a chamber in the housing, a window made of a coated transparent material provided in the cover enabling the viewer to see the interior of the chamber, a mirror surface provided on the front face of the back so as to reflect an image viewable through the window of any object placed in the chamber, walls on the housing defining a channel in the housing surrounding the chamber and not visible through the window, a number of lamp sockets disposed in the channel and open to the chamber, lamps disposed in the chamber and mounted in the sockets, and electrical conductors in the channel and connected to each of the sockets within the channel, said conductors extending out of the housing.

5. A Christmas tree ornament as defined in claim 4 wherein said housing being star-shaped and said lamps being located at the inner and outer points of the star.

6. A Christmas tree ornament as defined in claim 1 wherein at least one of said walls being formed as an integral part of the cover, and a wall on the back of the housing engaging said one of the walls for holding the housing closed.

7. A Christmas tree ornament as defined in claim 5 wherein at least one of said walls being formed as an integral part of the cover, and a wall on the back of the housing engaging said one of the walls for holding the housing closed.

8. A Christmas tree ornament as defined in claim 7 wherein a number of air ventilation holes in the back of the housing behind the lamps so that the holes are not visible in the chamber through the window.

* * * * *